US008955446B1

(12) United States Patent
Chuo

(10) Patent No.: US 8,955,446 B1
(45) Date of Patent: Feb. 17, 2015

(54) THREAD CUTTING MECHANISM FOR SEWING MACHINE

(71) Applicant: Shing Ray Sewing Machine Co., Ltd., New Taipei (TW)

(72) Inventor: Jui-Jung Chuo, New Taipei (TW)

(73) Assignee: Shing Ray Sewing Machine Co., Ltd., New Taipei (TW)

( * ) Notice: Subject to any disclaimer, the term of this patent is extended or adjusted under 35 U.S.C. 154(b) by 0 days.

(21) Appl. No.: 14/047,344

(22) Filed: Oct. 7, 2013

(51) Int. Cl.
*D05B 65/00* (2006.01)
*D05B 65/02* (2006.01)
*D05B 59/00* (2006.01)

(52) U.S. Cl.
CPC ..... *D05B 65/02* (2013.01)
USPC ..... 112/292

(58) Field of Classification Search
USPC ..... 112/130, 285, 291–298
See application file for complete search history.

(56) References Cited

U.S. PATENT DOCUMENTS 3,163,136 A * 12/1964 Pickett ..... 112/130
4,098,209 A * 7/1978 Schopf ..... 112/298
5,664,511 A * 9/1997 Tajima et al. ..... 112/292
6,070,540 A * 6/2000 Nomura et al. ..... 112/68
7,357,089 B1 * 4/2008 Chang ..... 112/285
7,380,511 B2 * 6/2008 Koike et al. ..... 112/291
8,025,017 B2 * 9/2011 Niizeki et al. ..... 112/291

FOREIGN PATENT DOCUMENTS

TW I320437 B 2/2010
TW M383002 6/2010

* cited by examiner

*Primary Examiner* — Ismael Izaguirre
(74) *Attorney, Agent, or Firm* — Muncy, Geissler, Olds & Lowe, P.C.

(57) ABSTRACT

A thread cutting mechanism is mounted on a sewing machine which includes a sewing platform. The thread cutting mechanism includes a driver assembly and a thread cutting assembly. The driver assembly includes a stepping motor, a swing lever pivotally connected to the stepping motor, and a pushing rod connected to the stepping motor and swing lever and driven jointly with the swing lever by the stepping motor to perform a back-and-forth process. The thread cutting mechanism is disposed on the sewing platform, and includes a thread hooking blade connected to and driven by the swing lever to move back-and-forth along a thread hooking path and to hook back a sewing thread, and a thread cutting blade disposed on the thread hooking path and for cutting the sewing thread when the thread hooking blade hooks back the sewing thread.

7 Claims, 9 Drawing Sheets

THREAD CUTTING MECHANISM FOR SEWING MACHINE

FIELD OF THE INVENTION

The present invention relates to an automatic thread cutting mechanism for a sewing machine, and particularly to a direct drive, automatic thread cutting mechanism for a zigzag-stitch sewing machine.

BACKGROUND OF THE INVENTION

In a common sewing machine, a sewing thread is usually cut via a thread cutting mechanism when coming to an end of stitches, so as to prepare for a next round of sewing. For example, the Taiwan Patent No. M383002, "Thread Trimming Structure for 3-Needle Coverstitch Machine with Extending Arm", discloses a thread trimming structure mounted on a sewing machine. The thread trimming structure includes a signal-controlled driver set for driving the thread trimming structure to operate. The driver set drives a pushing rod by a power source to perform a back-and-forth movement, i.e., to extend forward and return to an original position, so as to cause the pushing rod to drive a linkage set to actuate a hook element of a hook and cut set. As such, without manually trimming a thread, an end of the thread of a workpiece is withdrawn through hooking and then trimmed by a trimming blade, thereby achieving automatic thread trimming. For another example, the Taiwan Patent No. I320437 discloses a thread cutting device for a sewing machine. The thread cutting device, connected to a body of a sewing machine, includes a cam mechanism, a retaining mechanism, a supporting mechanism, a scissor driver set and thread scissors. The cam mechanism includes a cam, scissors and a positioning cam arm. The retaining mechanism includes a retaining arm and a movable assembly capable of sliding relative to the retaining arm. The supporting mechanism includes a base plate driven by the cam arm and connected to the movable assembly, and a supporting arm set connected to the base plate. The scissor driver set includes a driving arm connected to the scissor cam arm and a lever pivotally connected to the supporting arm set. The thread scissors include a fixed blade connected to the supporting arm set and a movable blade connected to the fixed blade.

In the thread cutting mechanisms for a sewing machine in the above disclosures, a structure for driving a blade is operated via a connecting rod set having at least two connecting rods. As a result, not only the structure is made more complicated, but also thread cutting operation may not be precisely achieved due to errors caused by size differences or disengagement of the connecting rods during a transmission process. Further, a conventional thread cutting mechanism is driven by a positioning motor that controls rotation of a cam, and a thread cutting speed of the scissor driver set, instead of being directly controlled by the positioning motor, is controlled through controlling a rotational speed of the cam by the positioning motor. That is to say an indirect drive mechanism is employed as the cam is provided between the scissor driver set and the positioning motor, thus leading to a greater possibility in imprecisely controlling thread cutting operation as described above.

SUMMARY OF THE INVENTION

Therefore the primary object of the present invention is to solve an issue of possible imprecise control on a thread cutting blade set of a conventional sewing machine, which is driven by a transmission mechanism having multiple connecting rods and a cam.

To achieve the above object, a thread cutting mechanism installed on a sewing machine is provided. The sewing machine includes a sewing platform. The thread cutting mechanism of the sewing machine includes a driver assembly, and a thread cutting assembly driven by the driver assembly. The driver assembly includes a stepping motor, a swing lever pivotally connected to the stepping motor, and a pushing rod connected to the stepping motor and swing lever and driven jointly with the swing lever by the stepping motor to perform a back-and-forth process. The swing lever includes a pivotal connection portion pivotally connected to the stepping motor, and a swing portion connected to and driven by the pushing rod to rotate about the pivotal connection portion serving as a fulcrum. The thread cutting assembly is disposed on the sewing platform, and includes a thread hooking blade and a thread cutting blade. The thread hooking blade is connected to and driven by the swing portion to move back-and-forth along a thread hooking path and to hook back a sewing thread. The thread cutting blade is disposed on the thread hooking path, and cuts off the sewing thread when the thread hooking blade hooks back the sewing thread.

In one embodiment, the thread cutting assembly includes a carrying portion disposed on the sewing platform, and a sliding groove formed on the carrying portion along the thread hooking path to allow the thread hooking blade and the thread cutting blade to slide back-and-forth thereon.

In one embodiment, the carrying portion includes two protruding portions disposed at two ends of the sliding groove to limit a movement of the thread cutting blade.

In one embodiment, the thread cutting assembly includes a cover covering the carrying portion and limiting a vertical movement of the thread cutting blade, and a support portion disposed at one end of the sliding groove and propping the thread hooking blade to tightly in contact with the thread cutting blade.

In one embodiment, the thread cutting blade includes a cutting portion disposed at one edge, and an opening formed along the thread hooking path. The thread hooking blade includes a penetration portion penetrating through the opening and abutting a wall of the opening to drive the thread cutting blade when moving, and a thread hooking portion disposed below the cutting portion and for hooking back the sewing thread.

In one embodiment, the thread cutting blade includes an abutting portion disposed at the other edge, and the thread hooking blade includes a butting portion disposed below the abutting portion. The thread cutting assembly includes a movement limiting portion disposed at one side of the thread cutting blade. The movement limiting portion includes an elastic member providing an elastic force, and a rotating arm driven by the elastic force to perform a rotation process. The rotating arm abuts against the abutting portion to limit a movement of the thread cutting blade when the thread hooking blade moves towards the sewing thread, and also is pushed away by the butting portion when the thread hooking blade hooks back the sewing thread.

In one embodiment, the stepping motor includes a rotation disk and a transmission portion. The transmission portion is disposed on the rotation disk and pivotally connected to the pushing rod, and drives the pushing rod to perform the back-and-forth process when the rotation disk rotates.

In one embodiment, the swing lever includes a reset portion. The reset portion is connected to and driven by the swing portion to rotate about the pivotal connection portion serving as a fulcrum. The driver assembly includes a sensing element which is disposed at the stepping motor and detects the reset portion to generate a stop signal.

In the present invention, the pushing rod is directly driven by the stepping motor to perform the back-and-forth process to drive the swing lever, and the swing lever further drives the thread hooking blade and the thread cutting blade to perform thread cutting. Between the stepping motor and the thread cutting assembly, only the pushing rod and the swing lever are involved for transmission. Compared to a conventional thread cutting device that is implemented by a complicated transmission mechanism having more than two connecting rods, the driving mechanism of the present invention is quite simple and direct. Therefore, transmission power can be lowered due to less connecting rod to significantly reduce transmission errors of the connecting rod, thereby more precisely controlling the thread cutting operation of the thread cutting assembly. Further, the rotational speed and angle of the rotation disk is also controlled via the stepping motor to directly control the thread cutting speed of the thread cutting assembly. Compared to a conventional thread, cutting device that indirectly controls thread cutting operation by controlling the rotational speed of the cam, the driving mechanism of the present invention controls the thread cutting operation more precisely.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 5A:
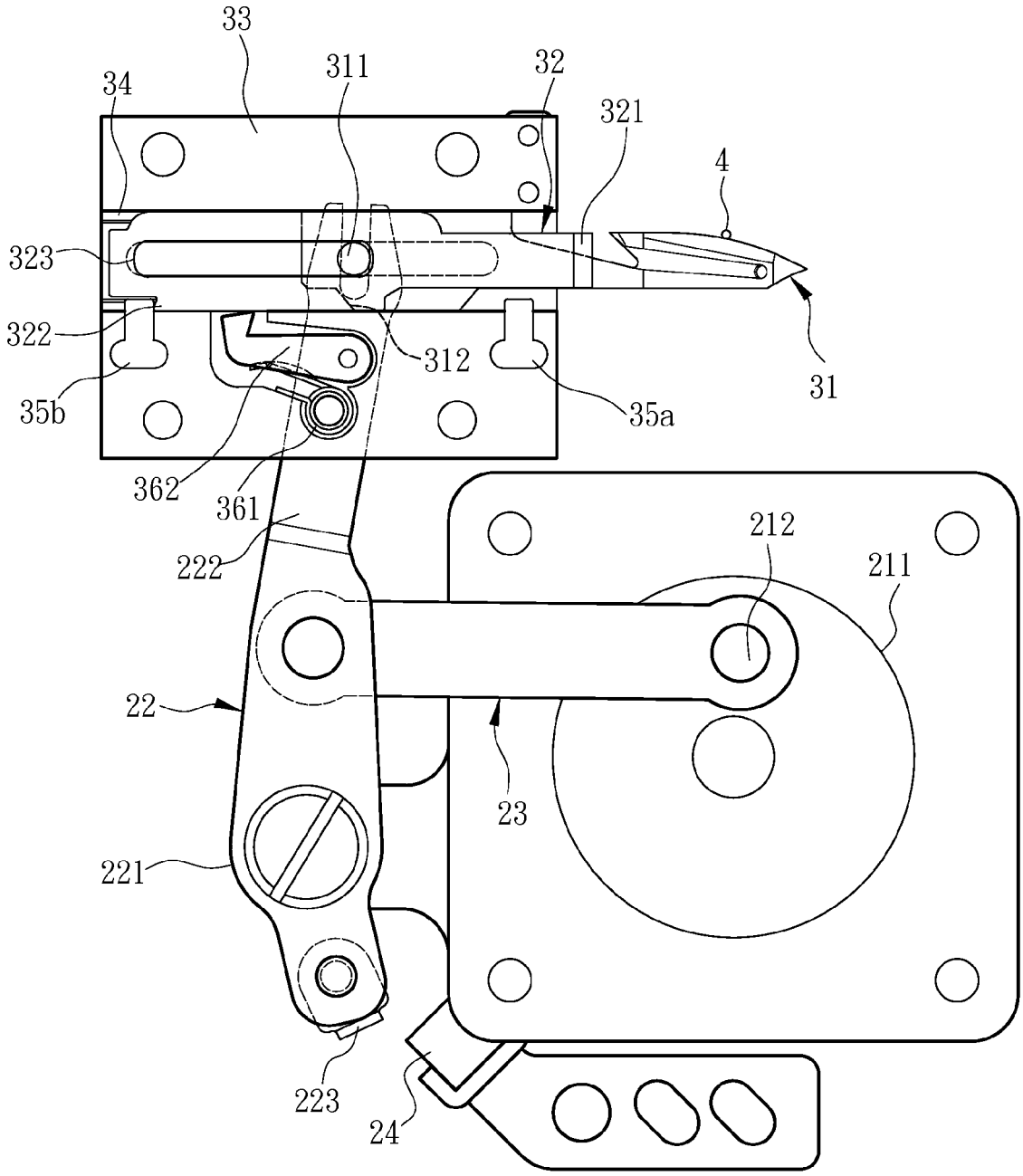
FIGS. 5A to 5E are schematic diagrams of operations according to a preferred embodiment of the present invention.
Figure 5B:
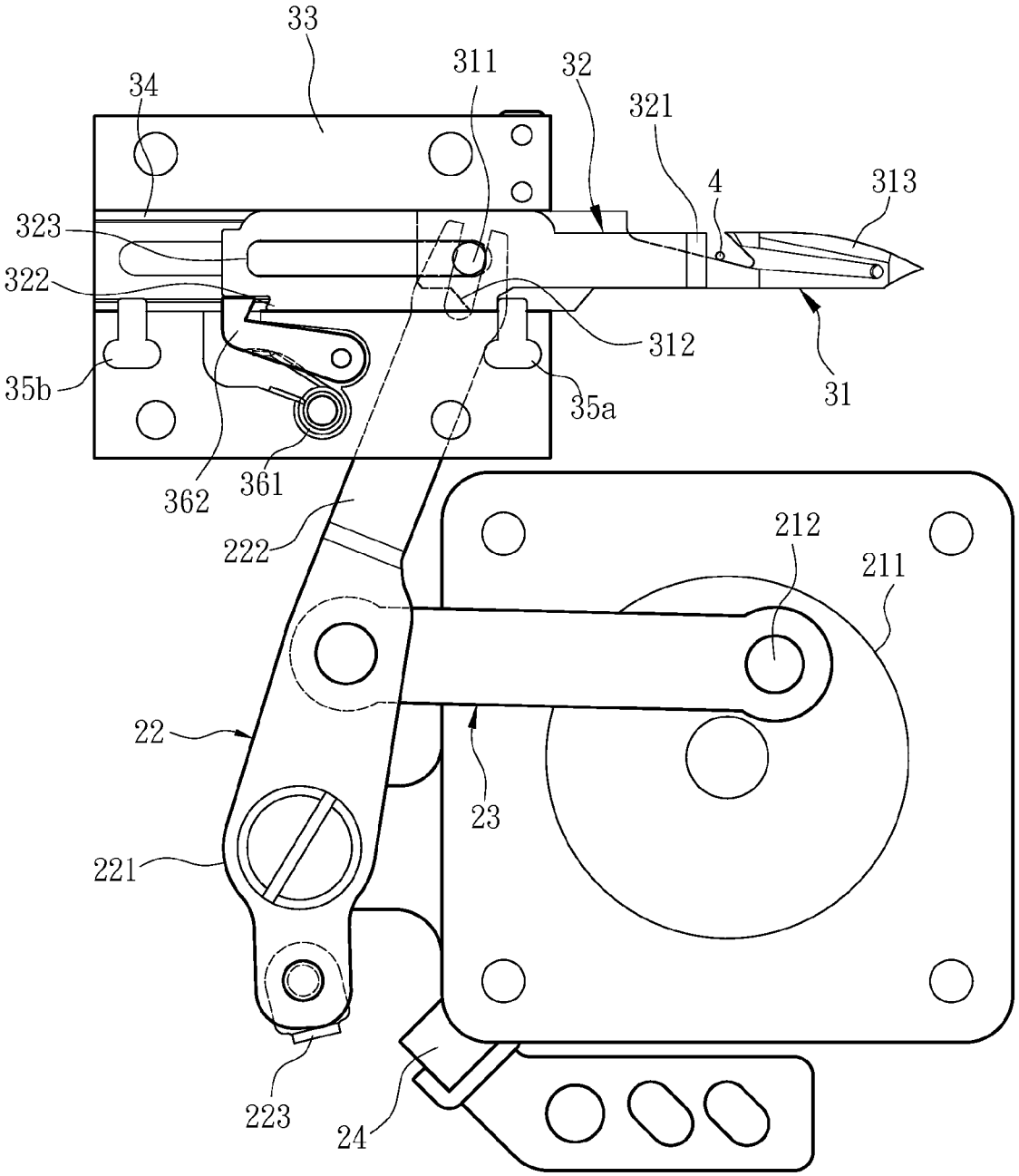
Figure 5C:
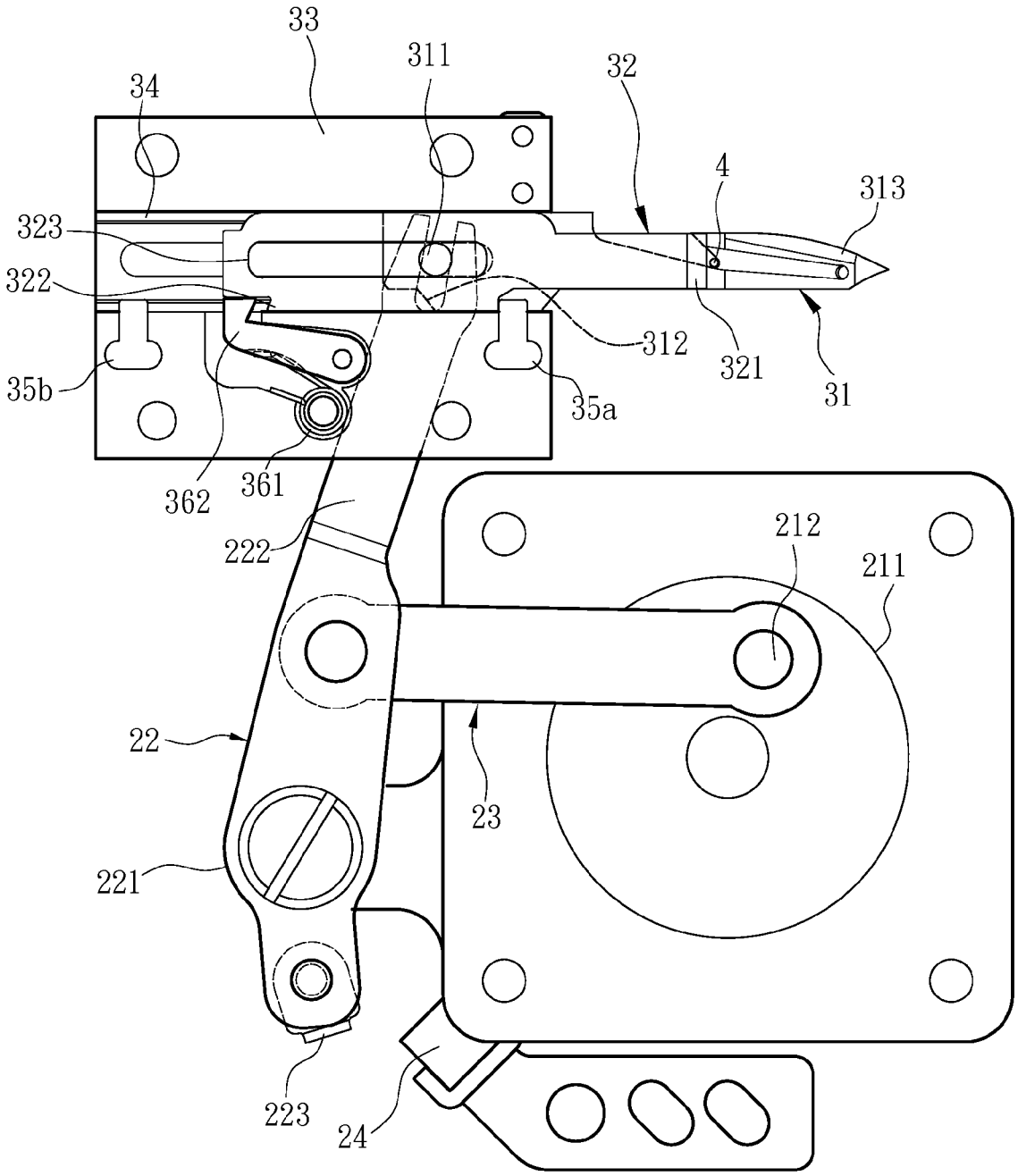
Figure 5D:
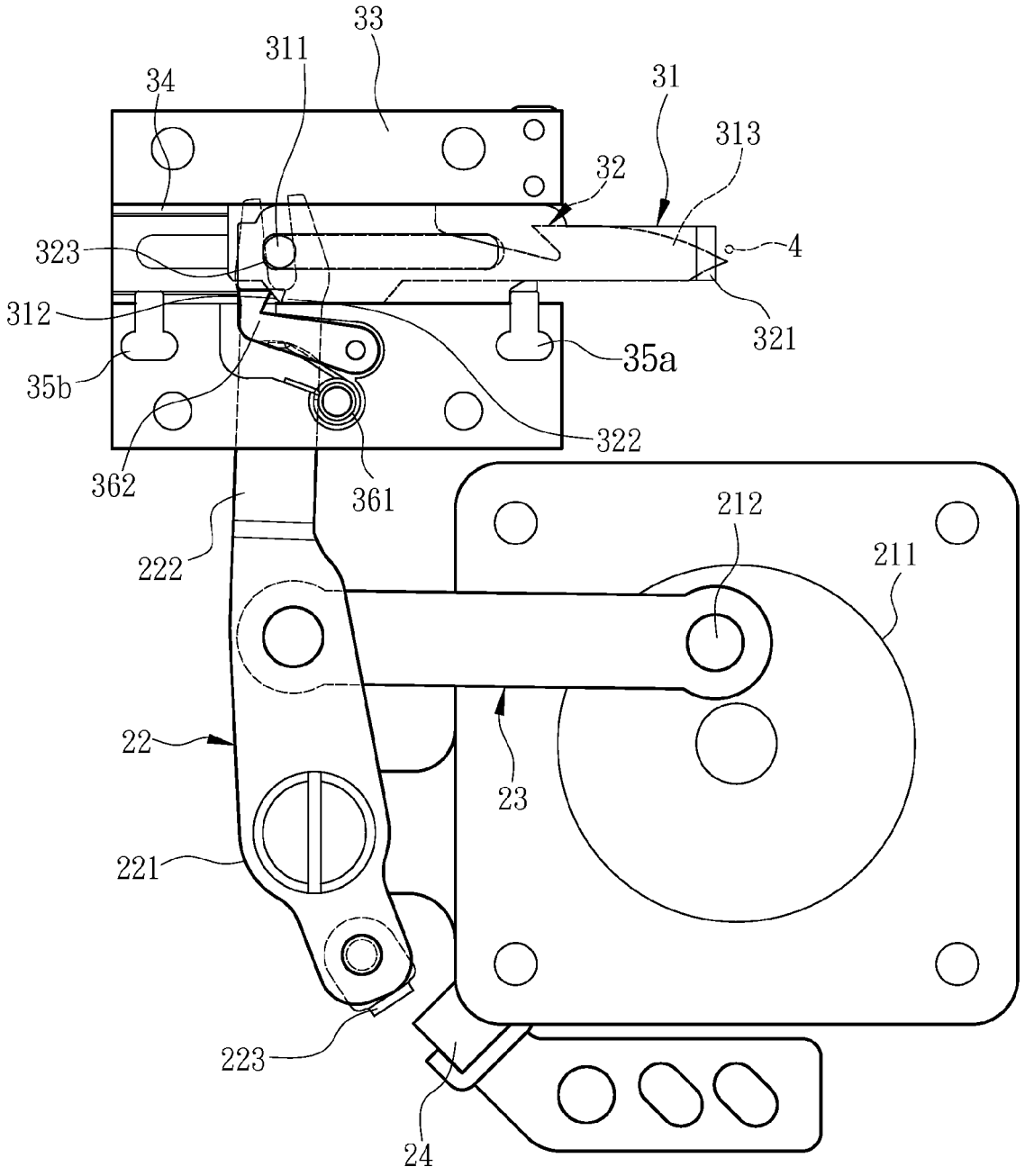
Figure 5E:
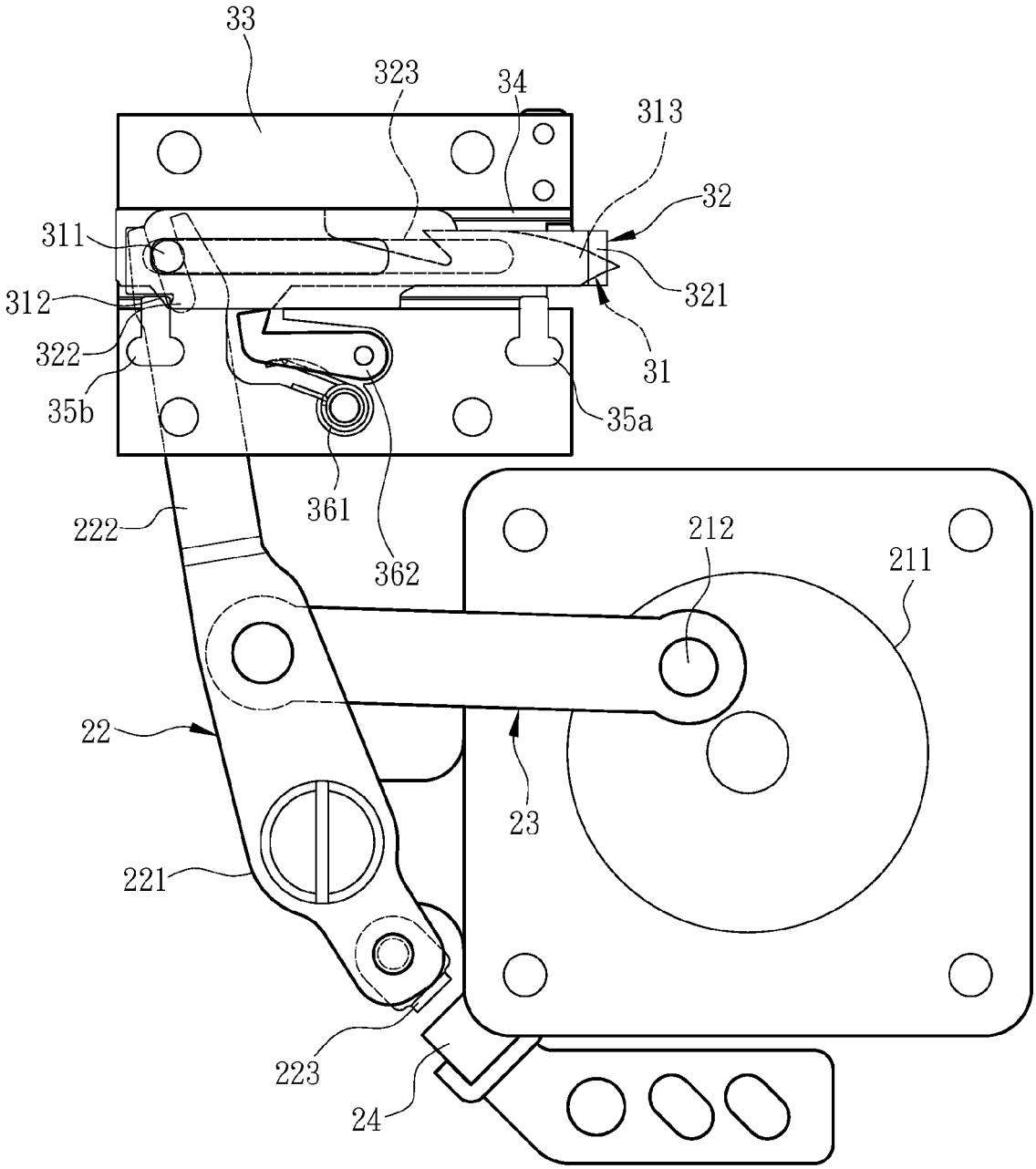

FIGS. 1, 2, 3 and 4 are an exploded view, a perspective view, an exploded structural view and a top view according to a preferred embodiment of the present invention, respectively. Referring to the diagrams, a thread cutting mechanism of the present invention is installed on a zigzag-stitch sewing machine 10. The zigzag-stitch sewing machine 10 is mainly for sewing lace borders, shoulder straps and general zigzag stitches, and includes a sewing platform 11. The thread cutting mechanism of the sewing machine 10 includes a driver assembly 2, and a thread cutting assembly 3 driven by the driver assembly 2 to perform thread cutting. The driver assembly 2 includes a stepping motor 21, a swing lever 22 pivotally connected to the stepping motor 21, and a pushing rod 23 connected to the stepping motor 21 and swing lever 22 and driven jointly with the swing lever 22 by the stepping motor 21 to perform a back-and-forth process. The swing lever 22 includes a pivotal connection portion 221 pivotally connected to the stepping motor 21, and a swing portion 222 connected to and driven by the pushing rod 23 to rotate about the pivotal connection portion 221 serving as a fulcrum. The thread cutting assembly 3 is disposed on the sewing platform 11, and includes a thread hooking blade 31 and a thread cutting blade 32. The thread hooking blade 31 is connected to and driven by the swing portion 222 to move back-and-forth along a thread hooking path R and to hook back a sewing thread 4 (shown in FIG. 5A). The thread cutting blade 32 is disposed on the thread hooking path R, and cuts off the sewing thread 4 when the thread hooking blade 31 hooks back the sewing thread 4.

More specifically, the stepping motor 21 includes a rotation disk 211 and a transmission portion 212. The transmission portion 212 is disposed on the rotation disk 211 and pivotally connected to the pushing rod 23, and drives the pushing rod 23 to perform the back-and-forth process when the rotation disk 211 rotates. The thread cutting assembly 3 includes a carrying portion 33 disposed on the sewing platform 11, a sliding groove 34 formed on the carrying portion 33 along the thread hooking path R to allow the thread cutting blade 32 and the thread hooking blade 31 to slide back-and-forth thereon, and two protruding portions 35*a* and 35*b* disposed at two ends of the sliding groove 34 to limit the movement of the thread cutting blade 32. The thread cutting blade 32 is disposed above the thread hooking blade 31, and includes a cutting portion 321 disposed at one edge, an abutting portion 322 disposed at the other edge, and an opening 323 formed along the thread hooking path R and between the cutting portion 321 and the abutting portion 322. The thread hooking blade 31 includes a penetration portion 311 penetrating through the opening 323, a butting portion 312 disposed below the abutting portion 322, and a thread hooking portion 313 disposed below the cutting portion 321 and for hooking back the sewing thread 4. The thread cutting assembly 3 further includes a movement limiting portion 36 disposed at one side of the thread cutting blade 32. The movement limiting portion 36 includes an elastic member 361 providing an elastic force, and a rotating arm 362 driven by the elastic force to perform a rotation process.

Operations details of the present invention are as shown in FIG. 5A to FIG. 5E. In an initial state, the thread cutting blade 32 and the thread hooking blade 31 are accommodated in the sliding groove 34, and the rotating arm 362 abuts against one side of the thread cutting blade 32 and the thread hooking blade 31. When the stepping motor 21 is powered on and the rotation disk 211 is rotated in a clockwise direction, the transmission portion 212 is driven to rotate to pull the pushing rod 23, and the pushing rod 23 further pulls the swing lever 22. At this point, the thread hooking blade 31 is driven by the swing lever 22 to move along the sliding groove 34, and then the penetration portion 311 of the thread hooking blade 31 abuts against a wall of the opening 323 of the thread cutting blade 32 to drive the thread cutting blade 32 to move along the sliding groove 34 until reaching the protruding portion 35*a*. When the thread cutting blade 32 abuts against the protruding portion 35*a* and no longer moves, the thread hooking blade 31 at the same time moves to the destination and stops moving to hook the sewing thread 4 via the thread hooking portion 313. The stepping motor 21 then drives the rotation disk 211 to rotate in a counterclockwise direction to push the pushing rod 23 outwards to further drive the swing portion 222 of the swing lever 22 to perform the rotation process. The thread hooking blade 31 is driven by the swing lever 22 to move backwards and hook back the sewing thread 4. At this point, the sewing thread 4 is clamped between the thread hooking blade 31 and the thread cutting blade 32. Next, the rotation disk 211 of the stepping motor 21 performs a second-stage counterclockwise rotation to further pull the thread hooking blade 31 backwards. At this point, the cutting portion 321 of the thread cutting blade 32 cuts off the sewing thread 4 to complete the two-stage thread cutting operation. When the thread hooking blade 31 continues to move backwards, the butting portion 312 pushes away the rotating arm 362, and meanwhile the penetration portion 311 abuts against the wall of the opening 323 of the thread cutting blade 32 to drive the thread cutting blade 32 to move backwards. The abutting portion 322 of the thread cutting blade 32 abuts against the other protruding portion 35*b* and stops moving to complete the entire thread cutting operation.

Further, the swing lever 22 of the present invention includes a reset portion 223. The reset portion 223 is connected to and driven by the swing portion 222, and rotates about the pivotal connection portion 221 serving as a fulcrum. The driver assembly 2 includes a sensing element 24. The sensing element 24 is disposed at the stepping motor 21, and detects the reset portion 223 to generate a stop signal. In the initial state, the reset portion 223 is located in front of the sensing element 24, thus the sensing element 24 is able to detect the reset portion 223 and to accordingly define an original position. When the stepping motor 21 drives the swing portion 222 to rotate, the reset portion 223 at the same time is driven by the swing portion 222 to rotate about the pivotal connection portion 221 to depart from the original position. When the stepping motor 21 later drives the rotation disk 211 to rotate in a counterclockwise direction to drive the thread cutting assembly 3 to perform thread cutting, as the reset portion 223 rotates reversely back to the original position, the sensing element 24 detects the reset portion 223 to generate the stop signal. The stop signal is transmitted to the stepping motor 21 to deactivate the stepping motor 21, so that the driver assembly 2 and the thread cutting assembly 3 return to the original position to achieve a reset effect.

Figure 1:
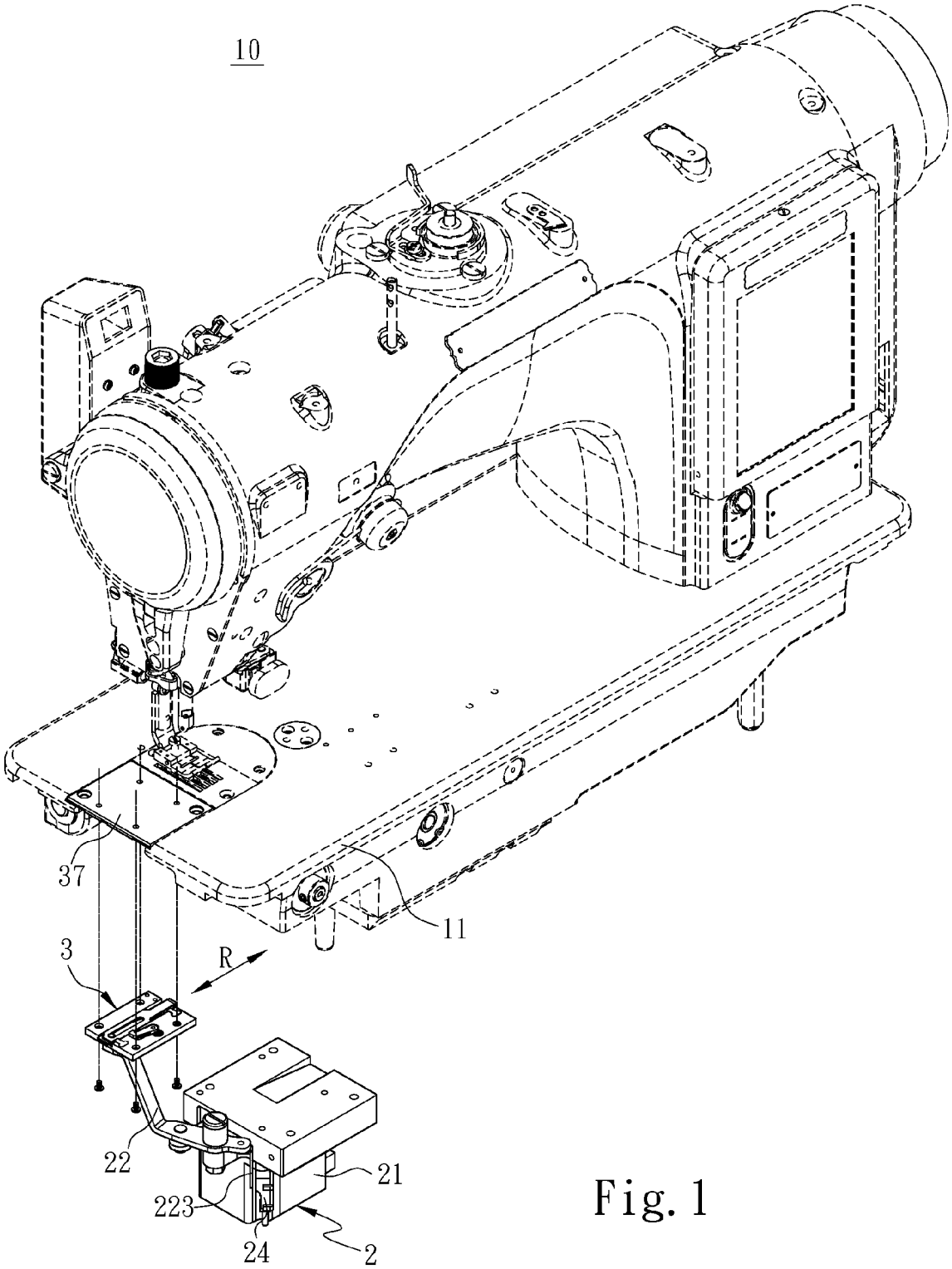
FIG. 1 is an exploded view of a sewing machine according to a preferred embodiment of the present invention.
Figure 2:
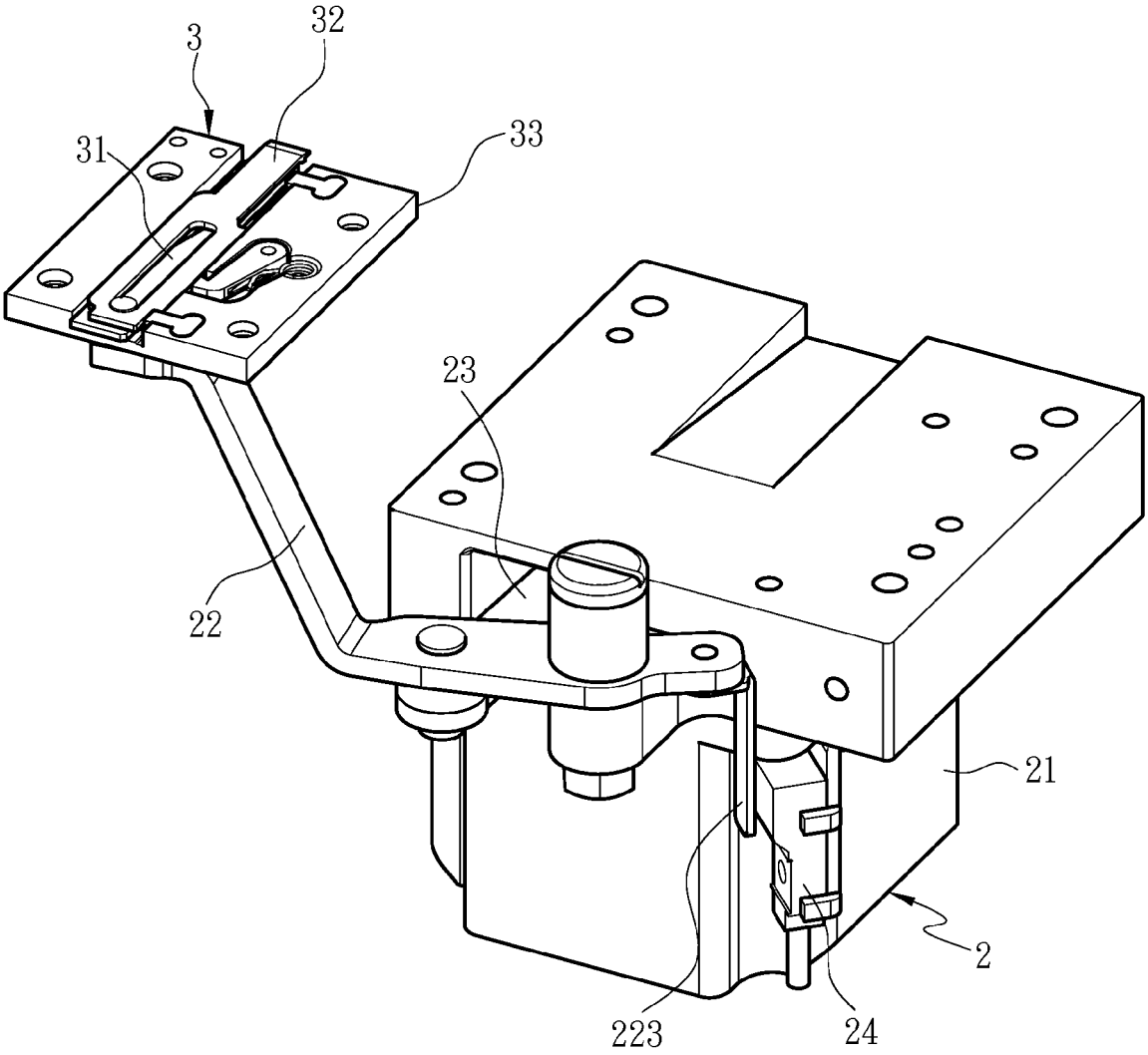
FIG. 2 is a perspective view according to a preferred embodiment of the present invention.
Figure 3:
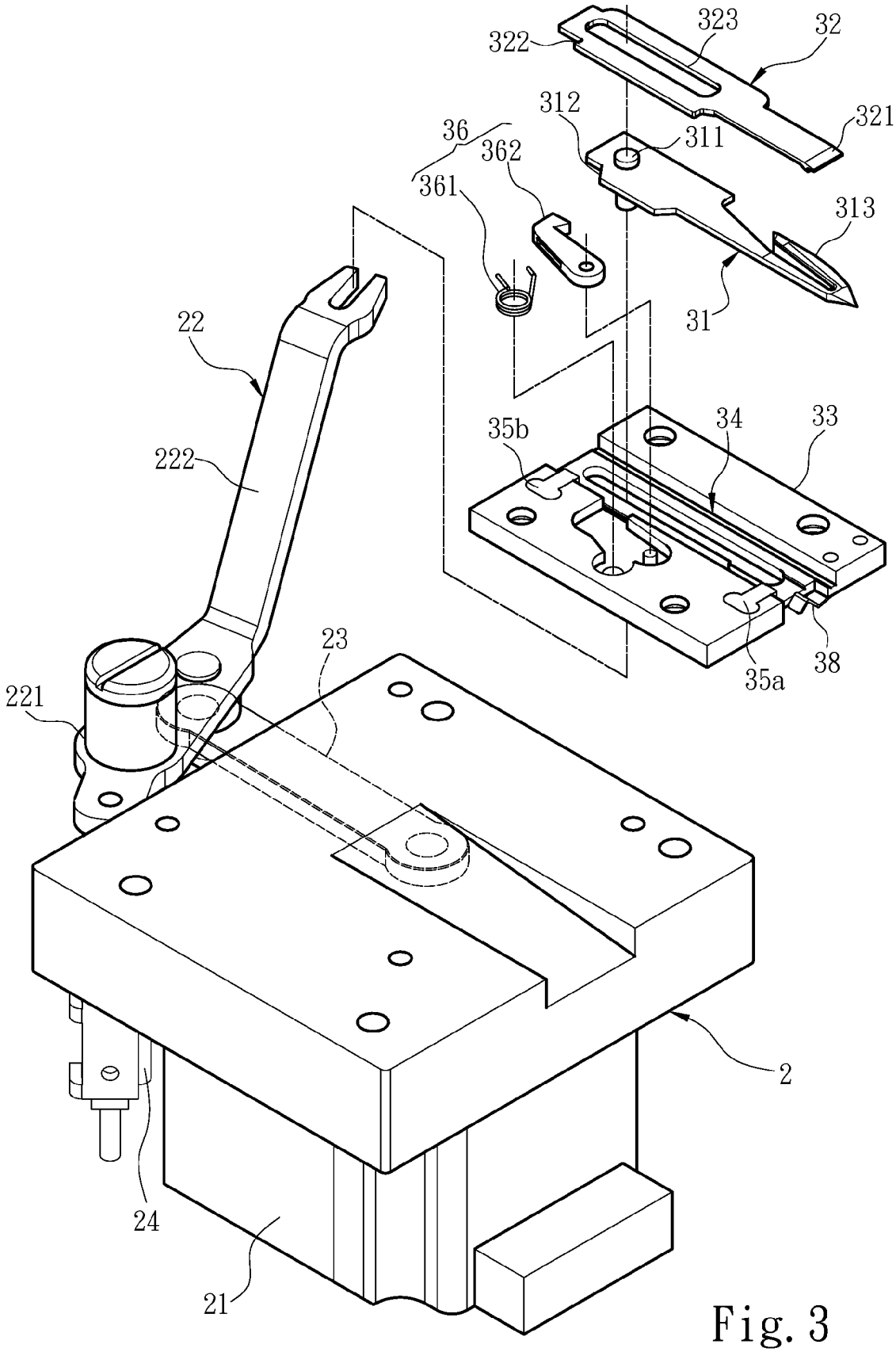
FIG. 3 is an exploded structural view according to a preferred embodiment of the present invention.
Figure 4:
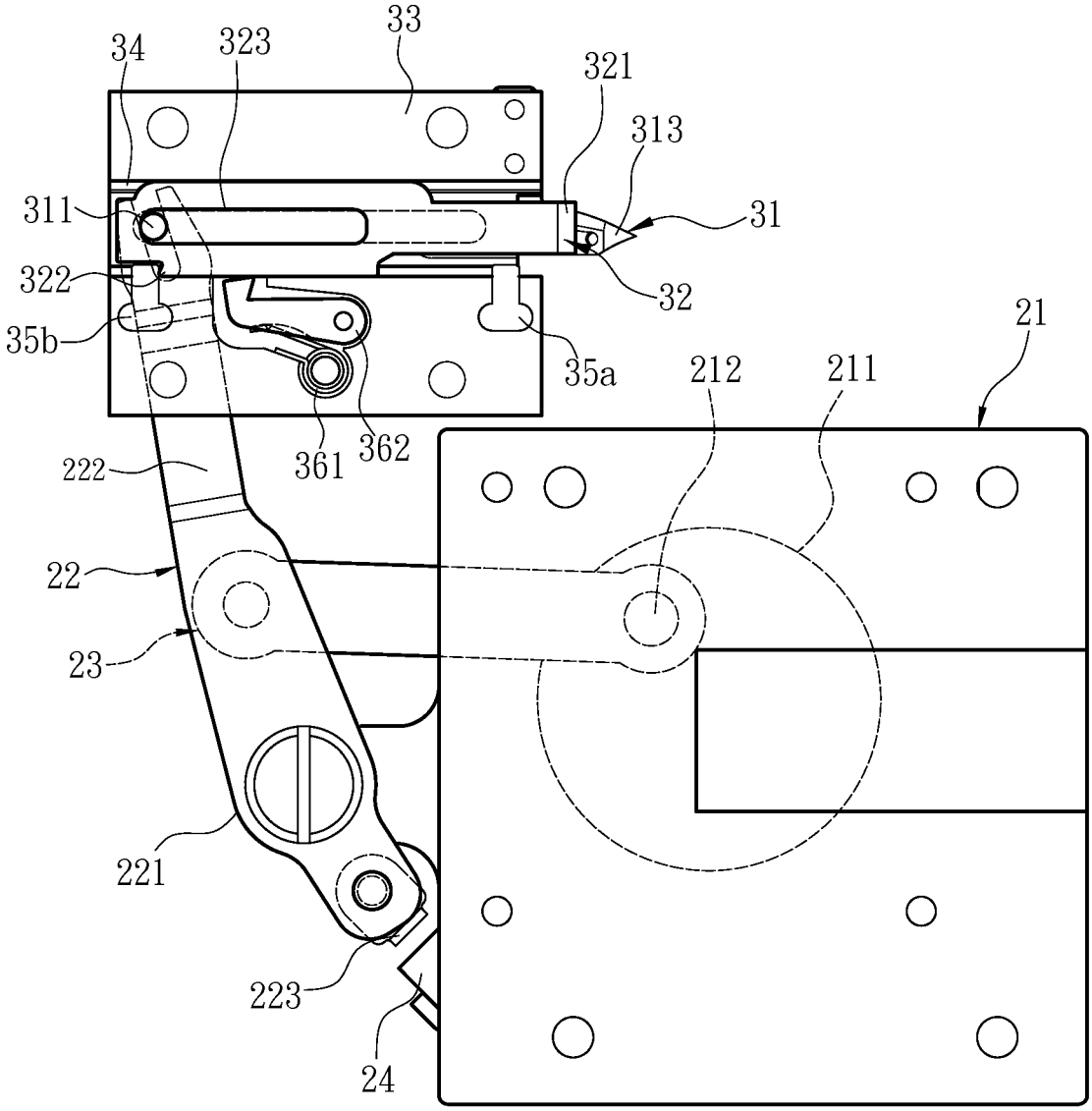
FIG. 4 is a top view according to a preferred embodiment of the present invention.

As shown in FIGS. 1 and 3, the thread cutting assembly 3 includes a cover 37 covering the carrying portion 33 and limiting a vertical movement of the thread cutting blade 32, and a support portion 38 disposed at one end of the sliding groove 34 and propping the thread hooking blade 31 to tightly in contact with the thread cutting blade 32. By clamping with the cover 37 and the support portion 38, the space between the thread hooking blade 31 and the thread cutting blade 32 is minimized, so as to quickly and firmly cut the sewing thread 4 when the thread hooking blade 31 hooks back the sewing thread 4.

In conclusion, in the present invention, the pushing rod 23 is directly driven by the stepping motor 21 to perform the back-and-forth process to drive the swing lever 22, and the swing lever 22 further drives the thread hooking blade 31 and the thread cutting blade 32 to perform thread cutting. Between the stepping motor 21 and the thread cutting assembly 3, only the pushing rod 23 and the swing lever 22 are involved for transmission. Compared to a conventional thread cutting device that is implemented by a complicated transmission mechanism having more than two connecting rods, the driving mechanism of the present invention is quite simple and direct. Therefore, transmission power can be lowered due to less connecting rod to significantly reduce transmission errors of the connecting rod, thereby more precisely controlling the thread cutting operation of the thread cutting assembly. Further, the rotational speed and angle of the rotation disk 211 is also controlled via the stepping motor 21 to directly control the thread cutting speed of the thread cutting assembly 3. Compared to a conventional thread cutting device that indirectly controls thread cutting operation by controlling the rotational speed of the cam, the driving mechanism of the present invention controls the thread cutting operation more precisely.

What is claimed is:

1. A thread cutting mechanism mounted on a sewing machine, the sewing machine comprising a sewing platform, the thread cutting mechanism comprising:

a driver assembly, comprising a stepping motor, a swing lever pivotally connected to the stepping motor, and a pushing rod connected to the stepping motor and the swing lever and driven jointly with the swing lever by the stepping motor to perform a back-and-forth process; wherein the swing lever comprises a pivotal connection portion connected to the stepping motor, and a swing portion connected to and driven by the pushing rod to rotate about the pivotal connection portion serving as a fulcrum; and a thread cutting assembly, disposed on the sewing platform, comprising a thread hooking blade connected to and driven by the swing portion to move back-and-forth along a thread hooking path and to hook back a sewing thread, and a thread cutting blade disposed on the thread hooking path and for cutting the sewing thread when the thread hooking blade hooks back the sewing thread;

wherein the thread cutting blade comprises a cutting portion disposed at one edge thereof, and an opening formed along the thread hooking path; the thread hooking blade comprises a penetration portion penetrating through the opening and abutting against a wall of the opening to drive the thread cutting blade when moving, and a thread hooking portion disposed below the cutting portion and for hooking back the sewing thread.

2. The thread cutting mechanism of claim 1, wherein the thread cutting assembly comprises a carrying portion disposed on the sewing platform, and a sliding groove formed on the carrying portion along the thread hooking path to allow the thread hooking blade and the thread cutting blade to slide back-and-forth thereon.

3. The thread cutting mechanism of claim 2, wherein the carrying portion comprises two protruding portions disposed at two ends of the sliding groove to limit a movement of the thread cutting blade.

4. The thread cutting mechanism of claim 2, wherein the thread cutting assembly comprises a cover covering the carrying portion and limiting a vertical movement of the thread cutting blade, and a support portion disposed at one end of the sliding groove and propping the thread hooking blade to tightly in contact with the thread cutting blade.

5. The thread cutting mechanism of claim 1, wherein the thread cutting blade comprises an abutting portion disposed at one other edge thereof; the thread hooking blade comprises a butting portion disposed below the abutting portion; the thread cutting assembly comprises a movement limiting portion disposed at one side of the thread cutting blade; the movement limiting portion comprises an elastic member providing an elastic force, and a rotating arm driven by the elastic force to perform a rotation process in which the rotating arm abuts against the abutting portion to limit the movement of the thread cutting blade when the thread hooking blade moves towards the sewing thread, and the rotating arm is pushed away by the butting portion when the thread hooking blade hooks back the sewing thread.

6. The thread cutting mechanism of claim 1, wherein the stepping motor comprises a rotation disk, and a transmission portion disposed on the rotation disk and pivotally connected to the pushing rod to drive the pushing rod to perform the back-and-forth process when the rotation disk rotates.

7. The thread cutting mechanism of claim 1, wherein the swing lever comprises a reset portion connected to and driven by the swing portion to rotate about the pivotal connection portion serving as a fulcrum; the driver assembly comprises a sensing element disposed at the stepping motor and detecting the reset portion to generate a stop signal.

* * * * *